US008803639B2

(12) United States Patent
Kawaguchi et al.

(10) Patent No.: US 8,803,639 B2
(45) **Date of Patent: *Aug. 12, 2014**

(54) VACUUM INSULATING CHAMBER INCLUDING WAVEGUIDES SEPARATED BY AN AIR GAP AND INCLUDING TWO PLANAR REFLECTORS FOR CONTROLLING RADIATION POWER FROM THE AIR GAP

(71) Applicant: Kabushiki Kaisha Toshiba, Minato-ku (JP)

(72) Inventors: Tamio Kawaguchi, Kanagawa-ken (JP); Hiroyuki Kayano, Kanagawa-ken (JP); Noritsugu Shiokawa, Kanagawa-ken (JP); Kohei Nakayama, Kanagawa-ken (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/911,299

(22) Filed: Jun. 6, 2013

(65) Prior Publication Data

US 2013/0265122 A1 Oct. 10, 2013

Related U.S. Application Data

(62) Division of application No. 12/638,428, filed on Dec. 15, 2009, now Pat. No. 8,570,120.

(30) Foreign Application Priority Data

Dec. 26, 2008 (JP) ..... 2008-332079

(51) Int. Cl.
*H01P 5/02* (2006.01)
*H01P 1/04* (2006.01)
*H01P 1/08* (2006.01)

(52) U.S. Cl.
CPC ..... *H01P 5/024* (2013.01); *H01P 1/042* (2013.01); *H01P 1/08* (2013.01)
USPC ..... 333/248; 333/254; 333/252

(58) Field of Classification Search
CPC ..... H01P 5/024; H01P 1/08; H01P 1/042
USPC ..... 333/254, 255, 252, 249, 248
See application file for complete search history.

(56) References Cited

U.S. PATENT DOCUMENTS

| | | | | |
|---|---|---|---|---|
| 3,389,352 | A * | 6/1968 | Kliphuis | 333/248 |
| 5,455,085 | A * | 10/1995 | Miller | 428/34 |
| 5,781,087 | A | 7/1998 | Milroy et al. | |
| 6,392,510 | B2 | 5/2002 | Gregorwich | |
| 8,570,120 | B2 * | 10/2013 | Kawaguchi et al. | 333/248 |
| 2008/0001686 | A1 | 1/2008 | Chao et al. | |
| 2009/0058571 | A1 | 3/2009 | Takemoto et al. | |

FOREIGN PATENT DOCUMENTS

| | | |
|---|---|---|
| JP | 61-57601 | 4/1986 |
| JP | 1-130449 | 5/1989 |

(Continued)

OTHER PUBLICATIONS

Office Action mailed Apr. 3, 2012 in Japanese Application No. 2008-332079 (with English-language translation).

*Primary Examiner* — Benny Lee
(74) *Attorney, Agent, or Firm* — Oblon, Spivak, McClelland, Maier & Neustadt, L.L.P.

(57) ABSTRACT

A heat insulating transmission line includes a first waveguide with a first aperture end, a second waveguide with a second aperture end, and a reflector. The second waveguide is arranged coaxially with the first waveguide. The second aperture end faces the first aperture end through an air gap. The reflector is provided outside the air gap, and controls radiation power from the air gap. In addition, the reflector is substantially parallel to a portion of a virtual plane connecting an inner wall of the first aperture end of the first waveguide and an inner wall of the second aperture end of the second waveguide. When a mean frequency of a signal transmitting through the heat insulating transmission line is expressed as λ, a distance between the virtual surface and the reflector is not less than $N\times\lambda/2-0.05\lambda$ and not more than $N\times\lambda/2+0.2\lambda$ (N is a positive integer).

3 Claims, 11 Drawing Sheets

(56) References Cited

FOREIGN PATENT DOCUMENTS

| | | |
|---|---|---|
| JP | 2-311001 | 12/1990 |
| JP | 4-213902 | 8/1992 |
| JP | 7-326910 | 12/1995 |
| JP | 3466509 | 8/2003 |
| JP | 2007-234343 | 9/2007 |
| JP | 2008-158305 | 7/2008 |

* cited by examiner

VACUUM INSULATING CHAMBER INCLUDING WAVEGUIDES SEPARATED BY AN AIR GAP AND INCLUDING TWO PLANAR REFLECTORS FOR CONTROLLING RADIATION POWER FROM THE AIR GAP

CROSS REFERENCE TO RELATED APPLICATION

This application is a division of and claims the benefit of priority under 35 U.S.C. §120 from U.S. Ser. No. 12/638,428 filed Dec. 15, 2009 (now U.S. Pat. No. 8,570,120 issued Oct. 29, 2013), and claims the benefit of priority under 35 U.S.C. §119 from Japanese Patent Application No. 2008-332079 filed Dec. 26, 2008, the entire contents of each of which are incorporated herein by reference.

FIELD OF THE INVENTION

The present invention relates to a heat insulating transmission line used for propagating a radio frequency signal, a vacuum insulating chamber, and a wireless communication system using the same.

DESCRIPTION OF THE BACKGROUND

A communication system which performs information communication by wireless or wire is constituted by various radio frequency components such as an amplifier, a mixer, and a filter. As a method to connect these components, there exist various methods for connecting by a coaxial line or a waveguide, or by a planar circuit such as a strip line, a microstrip line, etc.

Since a circumference of a waveguide is enclosed with metals, the waveguide does not have a radiation loss, and has a small insertion loss. Accordingly, the waveguide is a fundamental transmission line frequently used for a radio frequency transmission. The waveguide includes a pipe through which a radio wave transmits, and a flange used for connecting each waveguide circuit. The pipe and the flange are made of metals such as copper, brass, etc. However, since the waveguide employs a metal, the waveguide tends to be heavy to handle, and have a low electrical resistance. The waveguide also has a high heat conductivity of a metal to allow heat to easily move therein. For this reason, there has been a problem that a temperature control for a connection circuit becomes difficult.

In order to solve the problem, waveguides which are designed for a weight saving, or high heat insulation are disclosed. It is disclosed that a pipe and flange portions of a waveguide are molded using a synthetic resin with low heat conductivity, and the surface thereof is plated (JP-A 117-326910 (KOKAI)). It is also disclosed that a waveguide is cooled using cooling fluid around the waveguide (JP-A H4-213902 (KOKAI)). It is further disclosed that a slit is introduced into a portion of a waveguide to lengthen a thermal line length without changing a length of electricity for the waveguide, thus acquiring a heat insulating effect (JP-A H2-311001 (KOKAI)).

However, in any of the above-mentioned waveguides, the metal portions thereof are connected with each other, thereby causing a thermal release. It is tentatively possible to acquire a heat insulation effect by using a metal with low heat conductivity also for other transmission lines, such as a coaxial line, a microstrip line, etc. However, such a low heat conductivity metal has a high electrical resistance, thereby making it difficult to acquire a heat insulating transmission line with a low loss.

A system which operates at low temperatures using a refrigerator, etc. is cooled by housing the system in a vacuum insulating chamber. It is, however, necessary to connect the system and an external circuit for signal communication. A method for connecting the system and an external circuit is disclosed (JP 3466509). The method employs connectors to be fixed to the chamber. The connectors are capable of contacting electrically between the system and the external circuit while maintaining the chamber as a vacuum. However, the method gives rise to heat transfer into the inside of the chamber, because metal parts of the connectors are connected to the inside thereof.

A structure to maintain airtightness of a wave guide employing a dielectric material with a small radio-frequency resistance such as a ceramics, etc. and control a radio-frequency wave reflection due to the dielectric materials is disclosed (JP-A 2007-234343 (KOKAI)). A waveguide having an air gap provided to a choke flange thereof to increase a margin for dimension error of the flange is disclosed (USPA 200800001686).

SUMMARY OF THE INVENTION

According to a first aspect of the invention, a heat insulating transmission line to propagate a signal includes a first waveguide with a first aperture end, a second waveguide with a second aperture end, and a reflector. The second waveguide is arranged coaxially with the first waveguide. The second aperture end faces the first aperture end through an air gap. The reflector is provided outside the air gap, and controls radiation power from the air gap. In addition, the reflector is substantially parallel to a portion of a virtual plane connecting an inner wall of the first aperture end of the first waveguide and an inner wall of the second aperture end of the second waveguide, and the reflector is longer than a length of the air gap in an extending direction of the first waveguide. Furthermore, when a mean frequency of a signal transmitting through the heat insulating transmission line is expressed as $\lambda$, a distance between the virtual surface and the reflector is not less than $N\times\lambda/2-0.05\lambda$ and not more than $N\times\lambda/2+0.2\lambda$ (N is a positive integer).

According to a second aspect of the invention, a vacuum insulating chamber with insulation includes a housing whose inside can be maintained as a vacuum, and a heat insulating transmission line. The heat insulating transmission line includes a first waveguide with an aperture end, a second waveguide, a reflector, and an airtight component. The second waveguide is arranged coaxially with the first waveguide. The second aperture end faces the first aperture end through an air gap. In addition, the first waveguide is mounted outside the housing, and the second waveguide is mounted inside the housing. The reflector is substantially parallel to a portion of a virtual plane connecting an inner wall of the first aperture end of the first waveguide and an inner wall of the second aperture end of the second waveguide. The reflector is longer than a length of the air gap in an extending direction of the first waveguide. When a mean frequency of a signal transmitting through the heat insulating transmission line is expressed as $\lambda$, a distance between the virtual surface and the reflector is not less than $N\times\lambda/2-0.05\lambda$ and not more than $N\times\lambda/2+0.2\lambda$ (N is a positive integer).

According to a third aspect of the invention, a wireless communication system includes a signal processing circuit, a power amplifier, a heat insulating transmission line, a filter, and an antenna. The signal processing circuit performs transmission processing of send data to acquire a transmission signal. The power amplifier amplifies the transmission signal. The heat insulating transmission line transmits the amplified transmission signal, and includes a first waveguide with a first aperture end, a second waveguide with a second aperture end, and a reflector. The second waveguide is arranged coaxially with the first waveguide, the second aperture end facing the first aperture end through an air gap. The reflector is provided outside the air gap, and controls radiation power from the air gap. The filter filters the transmission signal. The antenna radiates the filtered transmission signal as an electromagnetic wave into the air. In addition, the reflector is substantially parallel to a portion of a virtual plane connecting an inner wall of the first aperture end of the first waveguide and an inner wall of the second aperture end of the second waveguide. The reflector is longer than a length of the air gap in an extending direction of the first waveguide. When a mean frequency of a signal transmitting through the heat insulating transmission line is expressed as $\lambda$, a distance between the virtual surface and the reflector is not less than $N\times\lambda/2-0.05\lambda$ and not more than $N\times\lambda/2+0.2\lambda$ (N is a positive integer).

DETAILED DESCRIPTION OF THE EMBODIMENTS

Figure 1A:
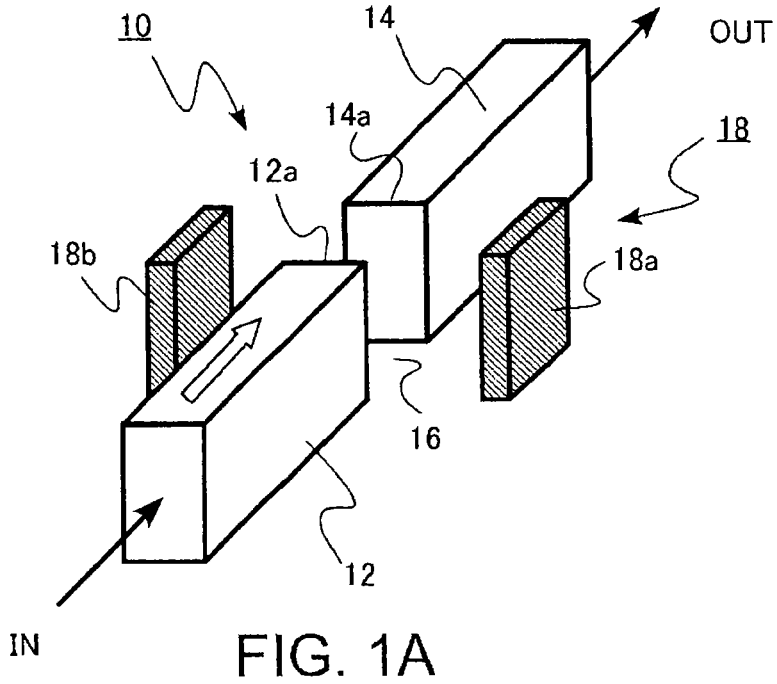
FIGS. 1A and 1B are perspective views of a heat insulating transmission line of a first embodiment.

Embodiments of the present invention are explained below with reference to accompanying drawings, wherein like reference numeral designations describe the same or corresponding parts or dimensions throughout the several views.

First Embodiment

A heat insulating transmission line of a first embodiment is provided with a first waveguide having a first aperture end, and a second waveguide having a second aperture end. The first and second waveguides are coaxially arranged with respect to each other. The first aperture end faces the second aperture end through an air gap. A reflector is arranged outside the air gap between the first and second waveguides to control radiation power from the air gap. The reflector is substantially parallel to a virtual plane coaxially connecting the inner walls of the first and second aperture ends of the first and second waveguides. The reflector is longer than a length of the air gap in an extending direction of the first waveguide. Furthermore, when a mean frequency of a signal transmitting through the heat insulating transmission line is expressed as $\lambda$, a distance between the virtual plane and the reflector is not less than $N\times\lambda/2-0.05\lambda$ and not more than $N\times\lambda/2+0.2\lambda$ (N is a positive integer).

The distance between the virtual plane and the reflector is mathematically defined. That is, when the virtual plane and the reflector are parallel to each other, the distance is defined as the shortest one between the virtual plane and the reflector.

Figure 1B:
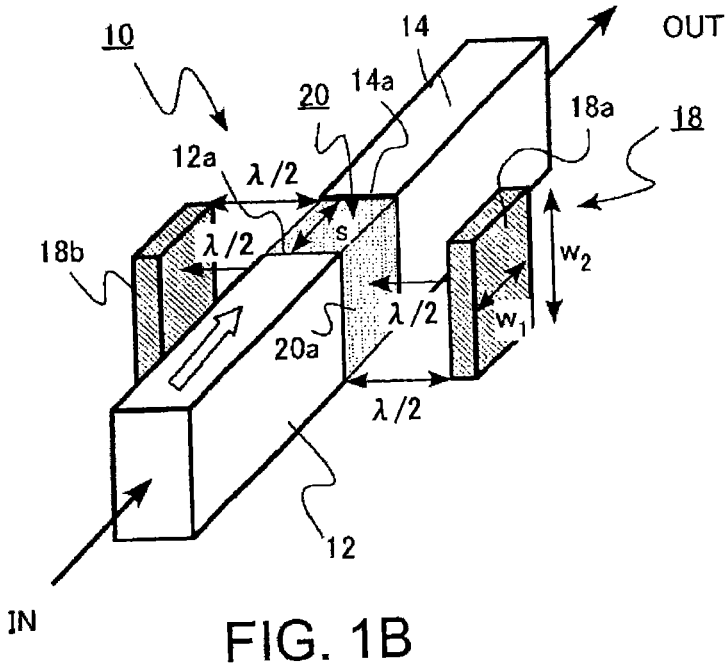
Figure 2B:
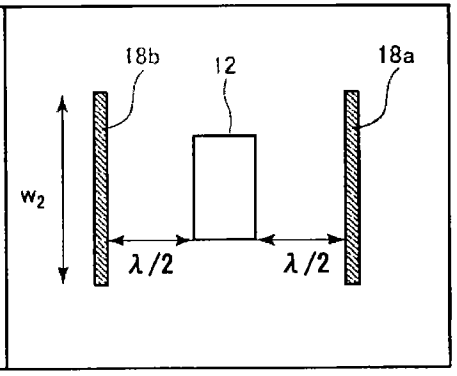
FIGS. 2A to 2C are views of the heat insulating transmission line of the first embodiment, viewed from three directions in FIG. 1A.
Figure 2A:
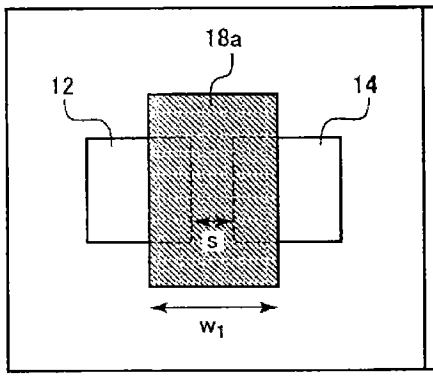
Figure 2C:
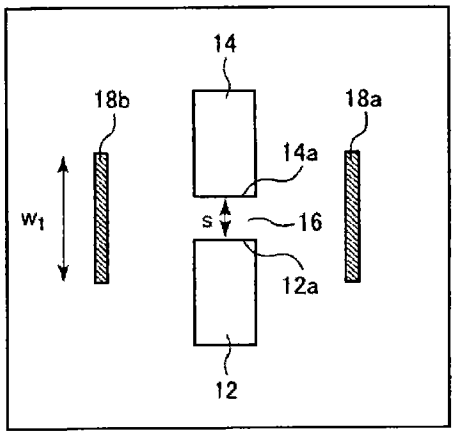

FIGS. 1A and 1B are perspective views of a heat insulating transmission line of the first embodiment. FIGS. 2A to 2C are views of the heat insulating transmission line of this embodiment, viewed from three directions in FIG. 1A. FIGS. 2A, 2B and 2C are a side view, a front view, and a top view, respectively.

As shown in FIG. 1A, the heat insulating transmission line 10 is provided with a first square waveguide 12 and a second square waveguide 14. The first waveguide 12 is disposed on a signal input side (IN), and the second waveguide 14 is disposed on a signal output side (OUT). The first waveguide 12 has an aperture end 12*a*, and the second waveguide 14 has an aperture end 14*a*.

The first waveguide 12 and the second waveguide 14 (IN, OUT) are coaxially arranged. The aperture end 14*a* of the second waveguide 14 faces the aperture end 12*a* of the first waveguide 12 across the air gap 16. Thus, the aperture end 12*a* of the first waveguide 12 and the aperture end 14*a* of the second waveguide 14 form a structure of a single waveguide which is just as sectionally cut on its longitudinal way.

The heat insulating transmission line 10 is further provided with a reflector 18. The reflector 18 includes two planar reflectors 18*a* and 18*b* which face each other across the air gap 16 sandwiched between the two planar reflectors 18*a* and 18*b*. That is, the reflector 18 is of a parallel plate type, and has a function to control the radiation power from the air gap 16.

And as shown in FIG. 1B, inner walls of the aperture ends 12*a* and 14*a* of the first and second waveguides 12, 14 (IN, OUT) are extended to the air gap, and connected to define a virtual plane 20. The reflectors 18 are substantially parallel to at least a portion of the virtual plane 20. Since the first and second waveguides 12, 14 (IN, OUT) are square-shaped, the virtual plane 20 in the heat insulating transmission line 10 becomes a square cylinder having four surfaces.

Two planar reflectors 18*a* and 18*b* are substantially parallel to the virtual plane 20*a* which includes a long side of the aperture end 12*a* of the first waveguide 12 (IN). Since the first and second waveguides 12, 14 (IN, OUT) are square-shaped, i.e., having a square-box shape, the aperture ends 12*a* and 14*a* perpendicular to an extending direction thereof are square in shape.

As shown in FIGS. 1A, 1B, and 2A, a length w1 of the reflector 18 in the extending direction of the first waveguide 12 (IN) is longer than the length "s" of the air gap 16 as shown in FIGS. 1B, 2A, and 2C. A length w2 shown in FIGS. 1B and 2B of the reflector 18 (FIG. 1B) in a direction perpendicular to the extending direction of the first waveguide 12 as shown in FIGS. 2B and 2C is longer than the long side of the aperture end 12*a* as shown in FIGS. 1B and 2C.

Furthermore, when a mean frequency of a signal transmitting through the heat insulating transmission line 10 is expressed as λ, a distance between the virtual plane 20 and the reflector 18 is not less than $N\times\lambda/2-0.05\lambda$ and not more than $N\times\lambda/2+0.2\lambda$ (N is a positive integer).

The configuration mentioned above of the heat insulating transmission line 10 allows it to realize excellent heat insulation and a low insertion loss with a simple structure. The air gap 16 arranged between the first and second waveguides 12, 14 provides very high heat insulation.

Then, the air gap 16 is provided to the waveguide to allow a radio frequency wave to leak therefrom, thereby causing radiation power into the air. For this reason, there is a risk of increasing the insertion loss as a result of the radiation power. The heat insulating transmission line 10 controls the radiation power from the air gap 16 by providing the reflector 18. Therefore, the insertion loss due to the radiation power is reduced.

Figure 3:
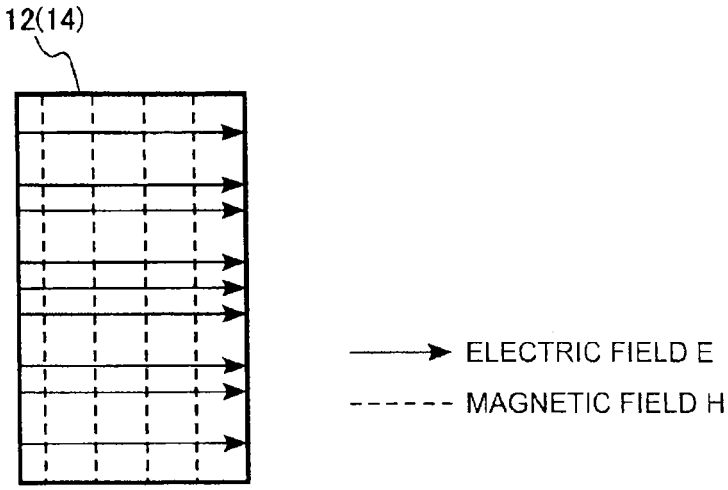
FIG. 3 is a view illustrating a fundamental propagating mode of the heat insulating transmission line of the first embodiment.

FIG. 3 is a view illustrating a fundamental propagating mode of the heat insulating transmission line of this embodiment. In FIG. 3, a distribution of electric field E and magnetic field H in a section perpendicular to the extending direction of the first or second waveguide is illustrated. Since the first and second waveguides 12, 14 are square-shaped, the section perpendicular to the extending direction of the waveguides is square.

As shown in FIG. 3, the fundamental propagating mode of the heat insulating transmission line 10 is a TE01 mode. Therefore, the radiation power into the air from the air gap 16 (FIG. 2C) becomes dominant radiation from the long side of the square of the section. For this reason, as shown in FIGS. 2A to 2C, when the planar reflectors 18*a* and 18*b* are arranged only on the sides of the long side of the aperture end, the radiation can be controlled effectively.

The virtual plane 20, shown in FIG. 1B, serves as a radiation source of electric power in the air gap 16. Therefore, when the planar reflectors 18*a* and 18*b* are arranged to substantially parallel to the virtual plane 20*a* including, e.g., the long side of the aperture end 12*a* of the first waveguide 12 (IN), a distance between the virtual plane 20 and the reflector 18*a*, and a distance between the virtual plane 20 and the reflectors 18*b* are set to be not less than $N\times\lambda/2-0.05\lambda$ and not more than $N\times\lambda/2+0.2\lambda$ (N is a positive integer) to suppress the insertion loss. Here, λis a mean frequency of a signal.

A position of a distance of $N\times\lambda/2$ (N is a positive integer) from the virtual plane 20, i.e., the radiation source, gives rise to a short circuit. As a result, the surfaces of the planar reflectors 18*a* and 18*b* at the position correspond to a short surface. For this reason, it becomes equivalent that this short surface is on the virtual plane 20 which is the radiation source. Thereby, the radiation from the air gap 16 is controlled. Therefore, it becomes possible to reduce the insertion loss by providing the air gap 16.

Here, the size of the planar reflectors 18*a* and 18*b* is preferably not less than that of the virtual plane 20 facing the planar reflectors, because the virtual plane 20 is a radiation source. For this reason, the length ($w_1$ in FIG. 1B) of the planar reflectors 18*a* and 18*b* in the extending direction (shown by the white arrow in FIGS. 1A and 1B) of the first waveguide 12 is set to be not shorter than the air gap length ("s" in FIG. 1B) in the heat insulating transmission line 10. The length ($w_2$ in FIG. 1B) of the planar reflectors 18*a* and 18*b* in the direction perpendicular to the extending direction of the first waveguide 12 is set to be not shorter than the length of the long side of the aperture end 12*a*.

Figure 4:
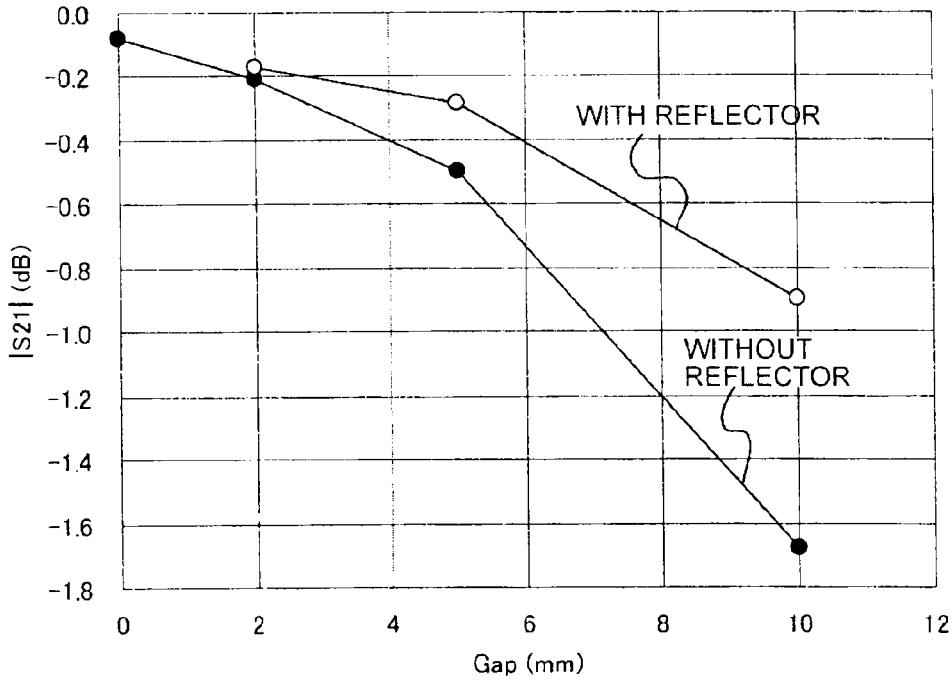
FIG. 4 is a graph illustrating changes in a transmission characteristic of the heat insulating transmission line with a reflector and without a reflector.

FIG. 4 is a graph illustrating changes in a passage characteristic of the heat insulating transmission lines with the reflector and without the reflector. The horizontal axis expresses the length in mm of the air gap, i.e., the distance corresponding to "s" in FIGS. 1B, 2A, and 2C. The vertical axis expresses the passage characteristic by |S21| in dB.

Figure 7B:
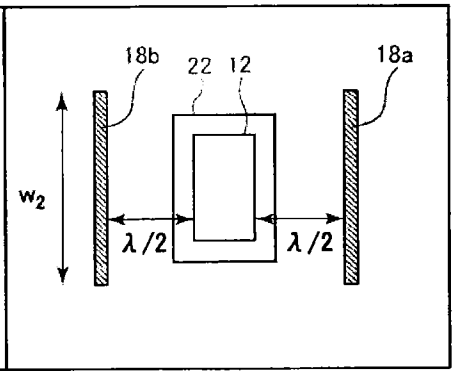
FIGS. 7A to 7C are respectively side, front and top views of the heat insulating transmission line of a modified example of the first embodiment.
Figure 7A:
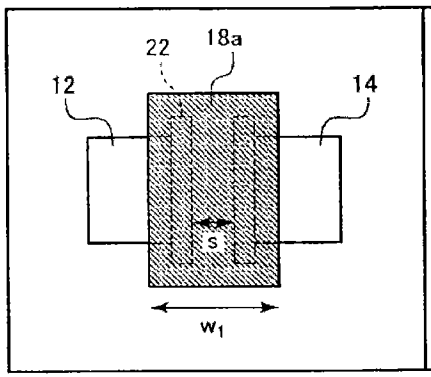
Figure 7C:
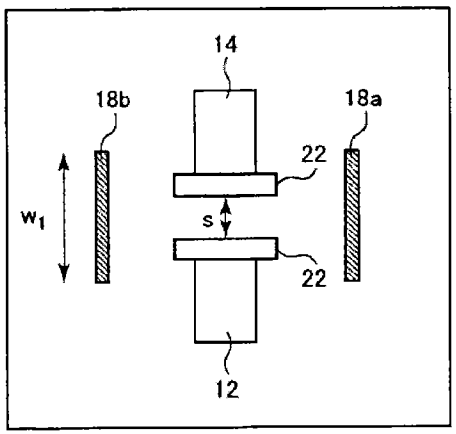

In addition, a waveguide with a flange 22 is used for the waveguide as a modified example of the present embodiment which will be described later, as shown in FIGS. 7A, 7B and 7C. A square WRJ-5 waveguide was used, and the center frequency of the signal inputted thereinto was 5.3 GHz. The reflectors using copper plates were arranged at a position of λ/2 from the virtual plane of the air gap for 5.3 GHz.

As a result, when the transmission line has no reflectors, the larger the air gap, the more the insertion loss, thereby worsening the passage characteristic. On the other hand, it is found that the passage characteristic is remarkably improved by providing the reflectors.

When the air gap length is 5 mm or less, the passage characteristic |S21| in dB is controlled by providing the reflectors to a trouble-free degree for practical use. Therefore, the air gap length is preferably 5 mm or less.

Figure 5:
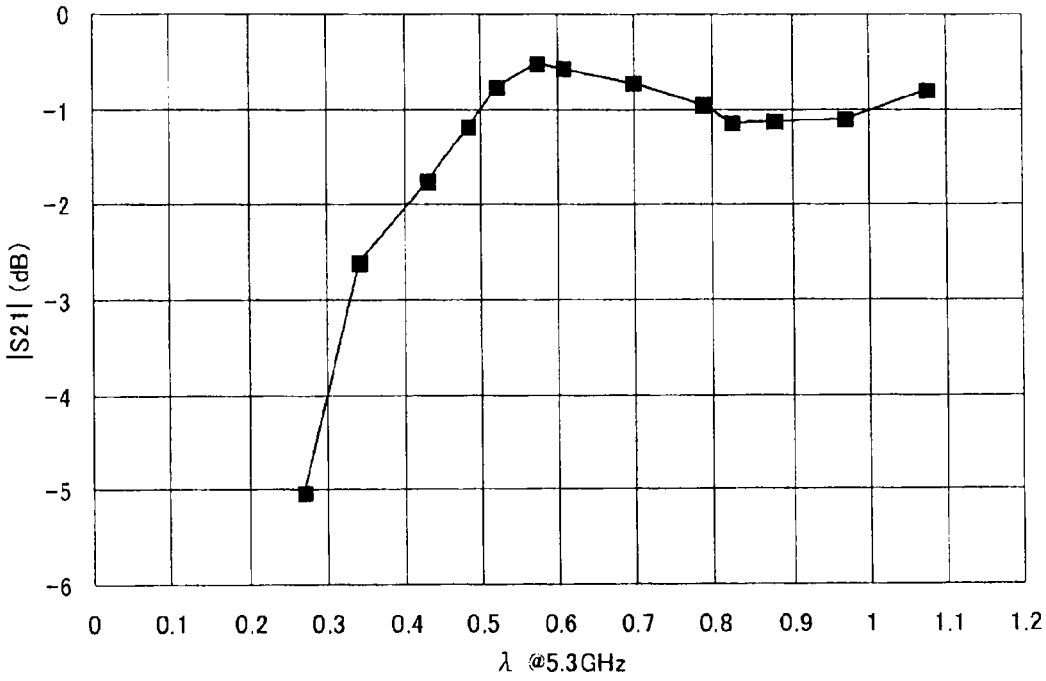
FIG. 5 is a graph showing a measurement of a transmission characteristic when changing the position of the reflectors to a waveguide.

FIG. 5 is a graph showing a measurement of the passage characteristic (|S21| in dB) when changing the position of the reflectors to that of the waveguide. Here, the square WRJ-5 waveguide was used, and the center frequency of the signal inputted thereinto was 5.3 GHz, similarly to the measurement of FIG. 4. Copper plates were used for the reflectors to measure the passage characteristic of the present transmission line with changing the position of the reflectors, the position measured in terms of the wavelength λof the input signal having a frequency of 5.3 GHz (denoted by "λ@5.3 GHz" in FIG. 5).

This measurement shows that the passage characteristic becomes best around at λ/2 (=0.5λ). Here, the position where the passage characteristic becomes best is slightly shifted from λ/2 to 0.57λ. As a result, it is understood to be preferable that a distance between the virtual plane 20 and the reflector 18 is not less than $N\times\lambda/2-0.05\lambda$ and not more than $N\times\lambda/2+0.2\lambda$ (N is a positive integer).

It is also preferable that the distance between the virtual plane 20 and the reflector 18 is shorter in order to enhance a reflection efficiency thereof. Therefore, N=1 is preferable.

Figure 6:
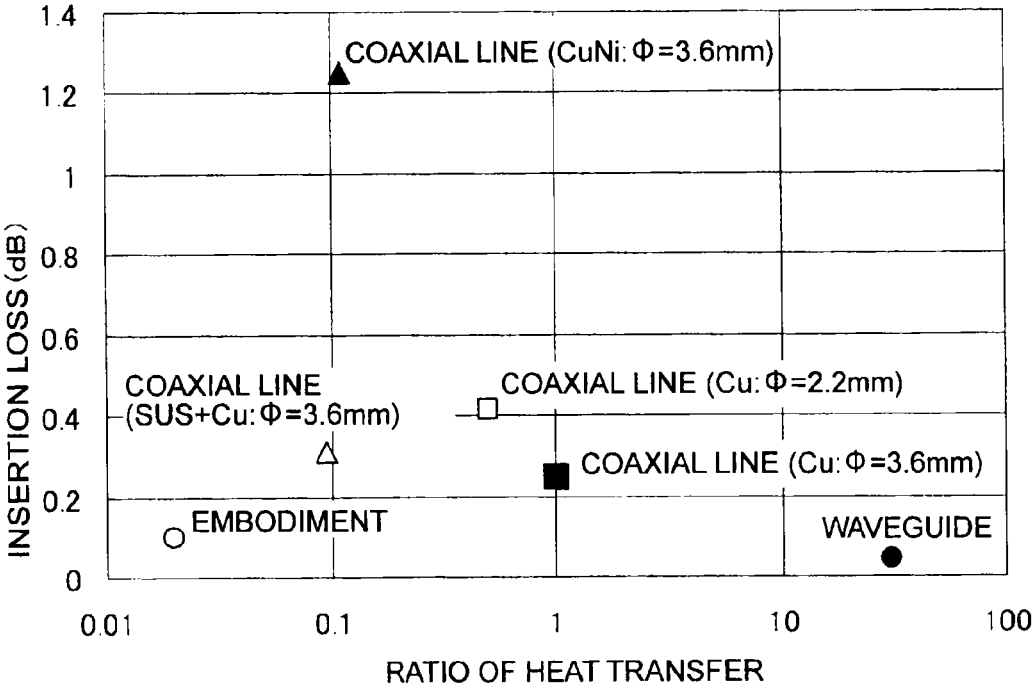
FIG. 6 is a graph showing a relationship between the insertion loss and a heat transfer rate of the embodiment and the related art.

FIG. 6 is a graph showing a relationship between the insertion loss in dB and a heat transfer ratio of the embodiment and the related arts. The same structure as that shown in FIG. 2 is employed for the embodiment. Examples of the related arts include a coaxial line using copper (Cu: Φ=3.6 mm and 2.2 mm), a coaxial line using cupronickel (CuNi: Φ=3.6 mm), a coaxial line using SUS and a copper film (SUS+the copper film: Φ=3.6 mm), and a common waveguide such as WRJ-5.

The relationship between the insertion loss and the heat transfer rate of the embodiment and the related arts is shown by providing the heat transfer of the copper coaxial line with a length of 10 m and Φ=3.6 mm as a reference point. As a result, it is clarified that the embodiment has the low insertion loss same as a waveguide and additionally high heat insulation.

Conductive materials such as a copper plate, a brass plate, gold or silver-plated component are preferably employed for the reflector 18 in order to enhance the reflection characteristic. It is also preferable that the reflector 18 is thermally disconnected to the waveguides 12 and 14 in order to enhance the heat insulation.

The above reflector has been described as a planar reflector, while the planar reflector can be changed to a curved reflector depending on the radiation pattern so that the curved reflector is located at a position of λ/2 from the radiation source, thus allowing it also to have an improved passage characteristic.

Components employed for the waveguide preferably include an INVAR (registered trademark) alloy, also known generically as FeNi36 (64FeNi in the US), with low thermal expansion, an injection-molded resin component, and a plated fiber-reinforced plastic.

Evacuating the air from the waveguide controls heat conduction by the air, thereby allowing it to acquire higher heat insulation.

FIGS. 7A to 7C are views of the heat insulating transmission line of a modified example of this embodiment, viewed from three directions. FIGS. 7A, 7B and 7C are a side view, a front view, and a top view, respectively.

The heat insulating transmission line of the modified example is the same as the heat insulating transmission line 10, except for the connecting flange 22 provided to the first and second waveguides 12, 14, as shown in FIGS. 7A, 7B and 7C. A commercially available waveguide is provided with a connecting flange. Even when the commercially available waveguide with a flange is diverted to form a heat insulating transmission line as well as in the modified example, the heat insulating transmission line can have the same effect as that in the first embodiment mentioned above.

Second Embodiment

A heat insulating transmission line of a second embodiment is the same as that of the first embodiment, except having a reflector with a shape of a square cylinder to cover the air gap. Therefore, the description overlapping with that of the first embodiment is omitted below.

Figure 8:
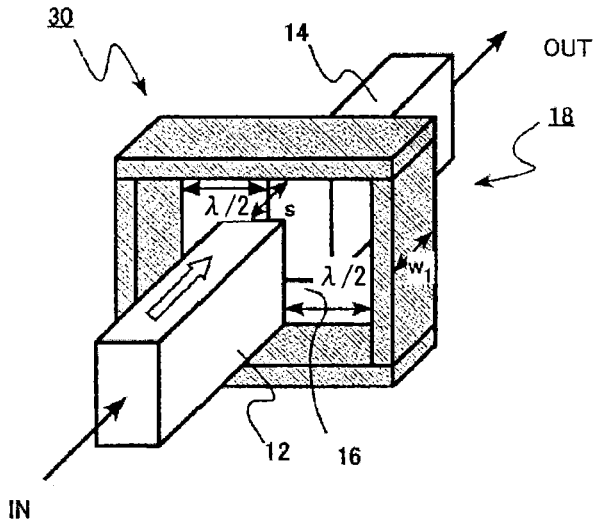
FIG. 8 is a perspective view illustrating the heat insulating transmission line of a second embodiment.

FIG. 8 is a perspective view illustrating the heat insulating transmission line of this embodiment. The heat insulating transmission line 30 has the reflector 18 with the shape of a square cylinder to cover the air gap 16. Two surfaces of the reflector 18 are substantially parallel to a virtual plane (not shown) including the long side of the aperture end of the first waveguide 12. The other two surfaces of the reflector 18 are substantially parallel to the virtual plane (not shown) including the short side of the aperture end of the first waveguide 12. That is, the four surfaces of the reflector 18 are parallel to four virtual planes coaxially connecting the inner walls of the first and second waveguides.

When a mean frequency of a signal transmitting through the heat insulating transmission line 30 is expressed as λ, the heat insulating transmission line 30 is surrounded by the reflector 18 around the radiation source thereof with placing a distance from the four virtual plane. The distance is not less than $N\times\lambda/2-0.05\lambda$ and not more than $N\times\lambda/2+0.2\lambda$ (N is a positive integer). As mentioned above, the surrounding area of the air gap 16 is covered to allow it to further reduce the insertion loss.

Third Embodiment

A heat insulating transmission line of a third embodiment has two planar reflectors both connected to the first waveguide by two supporters. The two planar reflectors, the two supporters and the first waveguide are formed by casting. Except the above-mentioned point, the heat insulating transmission line of the third embodiment is the same as that of the first embodiment. Therefore, the description overlapping with that of the first embodiment is omitted below.

Figure 9:
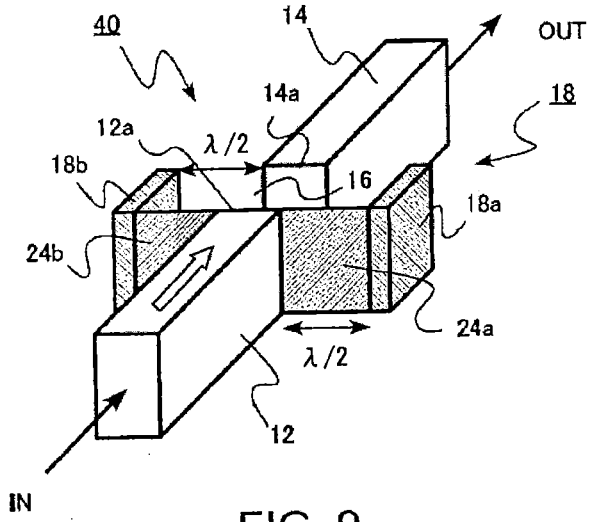
FIG. 9 is a perspective view of a heat insulating transmission line of a third embodiment.

FIG. 9 is a perspective view of the heat insulating transmission line of this embodiment. The two planar reflectors 18*a* and 18*b* both are connected to the first waveguide 12 by the supporters 24*a* and 24*b* to form a horseshoe shape in the heat insulating transmission line 40. The two planar reflectors 18*a*, 18*b*, the supporters 24*a* 24*b* and the first waveguide 12 are formed by casting.

According to the heat insulating transmission line 40, the waveguide and the reflectors can be manufactured in a single-piece construction, thereby allowing it to reduce the number of components of a transmission line to be more simplified.

Fourth Embodiment

In a heat insulating transmission line of a fourth embodiment, a first planar reflector of two reflectors is connected to the first waveguide by a first supporter. That is, the first planar reflector, the first supporter, and the first waveguide are formed by casting. A second planar reflector of the two reflectors is connected to the second waveguide by a second supporter. That is, the second planar reflector, the second supporter, and the second waveguide are formed by casting. Except for the above-mentioned point, the heat insulating transmission line of the fourth embodiment is the same as that of the first embodiment. Therefore, the description overlapping with that of the first embodiment is omitted below.

Figure 10:
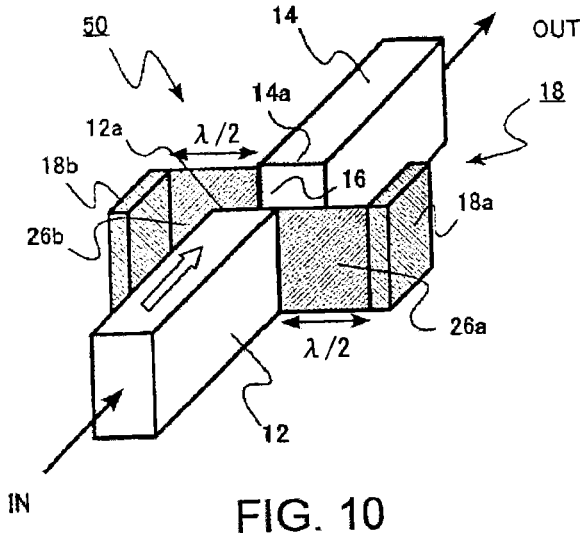
FIG. 10 is a perspective view of a heat insulating transmission line of a fourth embodiment.

FIG. 10 is a perspective view of the heat insulating transmission line of the fourth embodiment. In the heat insulating transmission line 50, the first planar reflector 18*a* is connected to the first waveguide 12 by the first supporter 26*a*. That is, the first planar reflector 18*a*, the first supporter 26*a*, and the first waveguide 12 are formed by casting. The second planar reflector 18*b* is connected to the second waveguide 14 by the second supporter 26*b*. That is, the second planar reflector 18*b*, the second supporter 26*b*, and the second waveguide 14 are formed by casting.

According to the heat insulating transmission line 50, the waveguide and the reflectors can be manufactured in a single-piece construction, thereby allowing it to reduce the number of components of a transmission line to be more simplified.

Fifth Embodiment

A heat insulating transmission line of a fifth embodiment is the same as that of the first embodiment, except having a reflector with a circular cylinder shape to cover the air gap. Therefore, the description overlapping with that of the first embodiment is omitted below.

Figure 11:
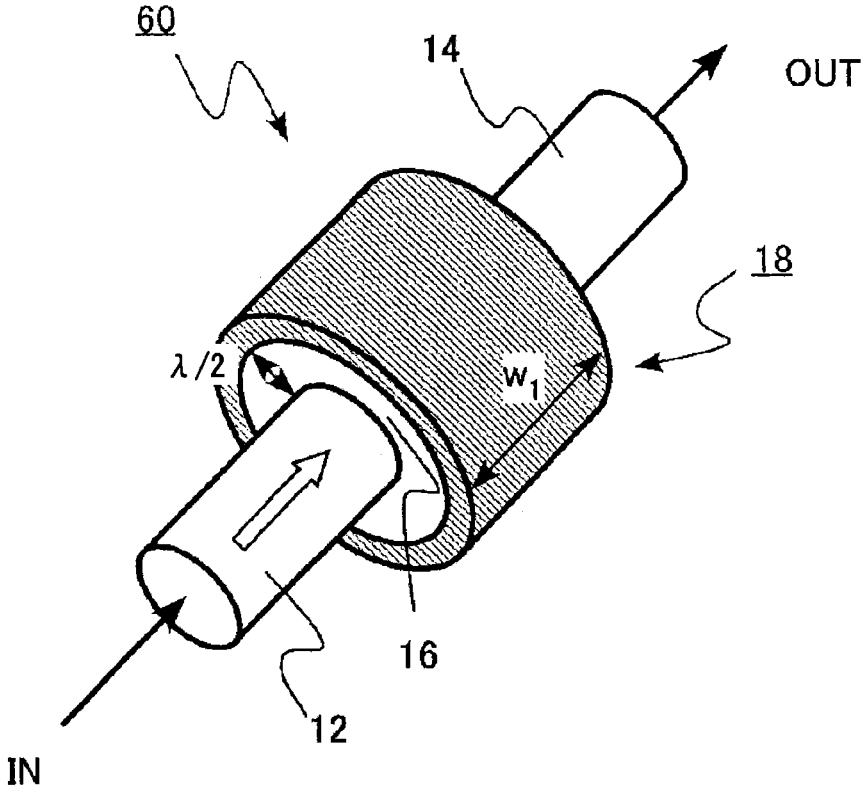
FIG. 11 is a perspective view of a heat insulating transmission line of a fifth embodiment.

FIG. 11 is a perspective view of the heat insulating transmission line of the fifth embodiment. As shown in FIG. 11, in the heat insulating transmission line 60, both the first and second waveguides 12, 14 have a cylindrical shape. The reflector 18 is also a circular cylinder in shape to cover the air gap 16 between the first and second waveguides 12, 14.

The reflector 18 is substantially parallel to an entire cylindrical virtual surface coaxially connecting the inner walls of the first and second waveguides 12, 14. Furthermore, when a mean frequency of a signal transmitting through the heat insulating transmission line is expressed as λ, a distance between the virtual plane and the reflector is not less than $N\times\lambda/2-0.05\lambda$ and not more than $N\times\lambda/2+0.2\lambda$ (N is a positive integer).

Figure 12:
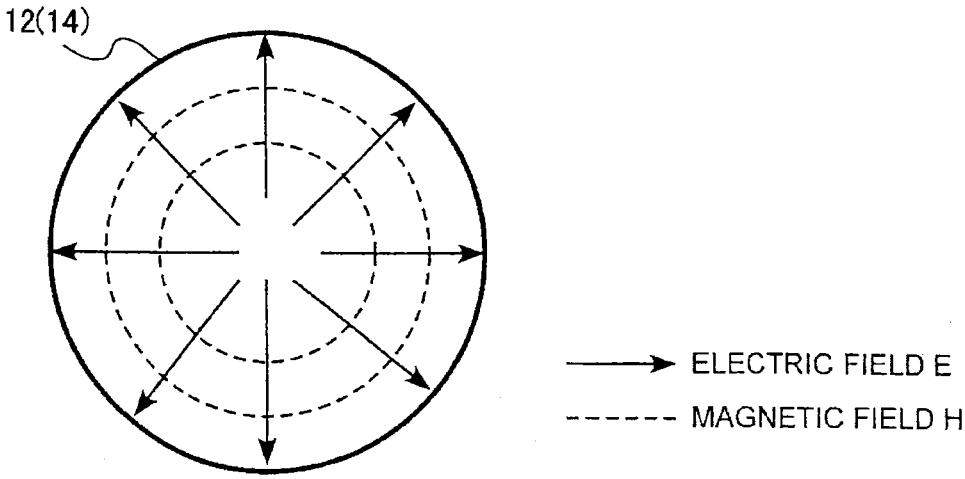
FIG. 12 is a view illustrating a fundamental propagating mode of the heat insulating transmission line of the fifth embodiment.

FIG. 12 is a view illustrating a fundamental propagating mode in the heat insulating transmission line of this embodiment. FIG. 12 illustrates an example of an electromagnetic field distribution at a section perpendicular to an extending direction of the first waveguide or the second waveguide. The electromagnetic field distribution is expressed by the electric field E (denoted by the arrows) and the magnetic field H (denoted by dotted lines). The section is a circle in shape, as the first and second waveguides 12, 14 are cylindrical.

As shown in FIG. 12, the fundamental propagating mode in the heat insulating transmission line 60 is a TM01 mode. In the case of the TM01 mode, the radiation from the air gap of the waveguide becomes uniform in a radial direction. Therefore, the heat insulating transmission line 30 is preferably surrounded by the cylindrical reflector 18 around the cylindrical virtual surface of the radiation source with placing a distance from the four virtual planes. The distance is not less than $N\times\lambda/2-0.05\lambda$ and not more than $N\times\lambda/2+0.2\lambda$ (N is a positive integer).

Sixth Embodiment

A vacuum insulating chamber of a sixth embodiment has heat insulation. The vacuum insulating chamber is provided with a housing whose interior can be maintained as a vacuum, equipment housed within the housing, and a heat insulating transmission line capable of transmitting and receiving a signal between the equipment and a circuit outside the housing. Then, one of the heat insulating transmission lines mentioned in the first to fifth embodiments is applied to the heat insulating transmission line of the sixth embodiment. Therefore, a detailed description on the heat insulating transmission line is omitted. However, the heat insulating transmission line of this embodiment is provided with an airtight component to maintain the housing as a vacuum.

Figure 13:
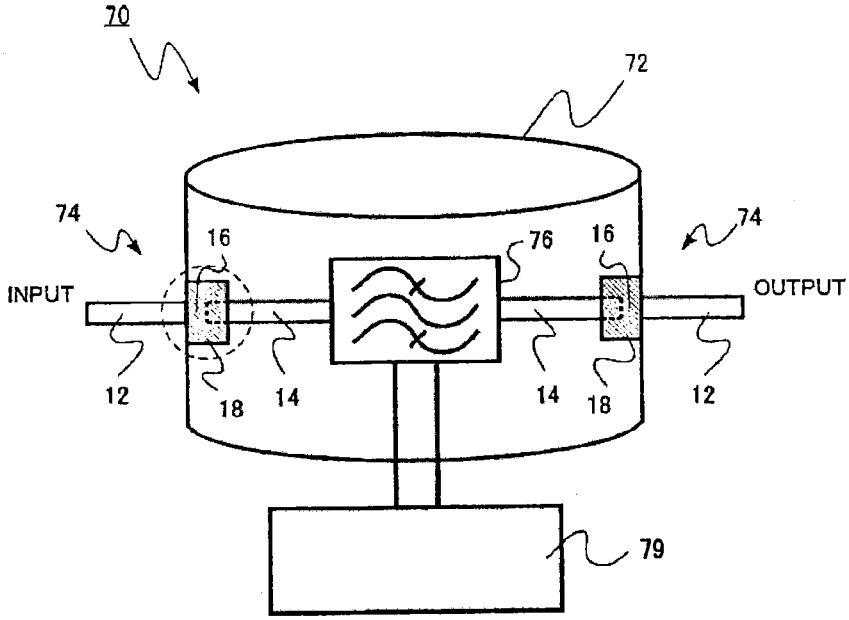
FIG. 13 is a schematic view illustrating a vacuum insulating chamber of a sixth embodiment.

FIG. 13 is a schematic view illustrating the vacuum insulating chamber of this embodiment. As shown in FIG. 13, the vacuum insulating chamber 70 having heat insulation is provided with the housing 72, equipment housed within the housing, and the heat insulating transmission line 74 capable of transmitting and receiving a signal between the equipment and a circuit outside the housing.

Here, a case where the superconducting filter 76 is installed as equipment in the housing 72 of the vacuum insulating chamber 70 is explained as an example. This superconducting filter 76 is cooled by the refrigerator 79 placed outside the housing 72.

The heat insulating transmission line 74 transmitts/receives a signal between the superconducting filter 76 inside the housing 72 and a circuit outside the housing 72. In the vacuum insulating chamber 70, the heat insulating transmission lines 74 is provided to an input side to which a signal is inputted from a circuit outside the housing 72, and an output side through which a signal is outputted from the equipment inside the housing 72 to a circuit outside the housing 72.

The heat insulating transmission line 74 is provided with the first waveguide 12 provided to the outside of the housing 72, and the second waveguide 14 provided to the inside of the housing 72. The heat insulating transmission line 74 is further provided with the reflector 18 to control radiation power from the air gap 16. The reflector is provided inside the housing 72, and outside the air gap 16 between the first and second waveguides 12, 14.

Figure 14B:
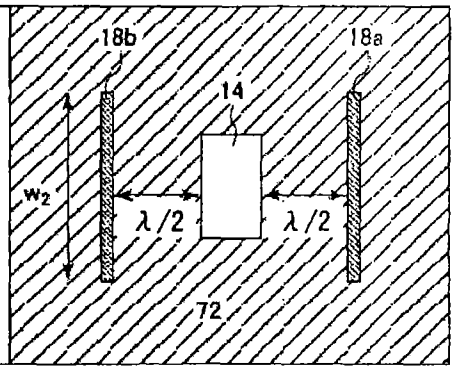
FIGS. 14A to 14C are views of the heat insulating transmission line of the sixth embodiment viewed from three directions in FIG. 13.
Figure 14A:
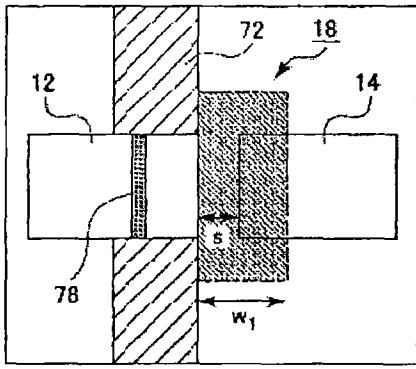
Figure 14C:
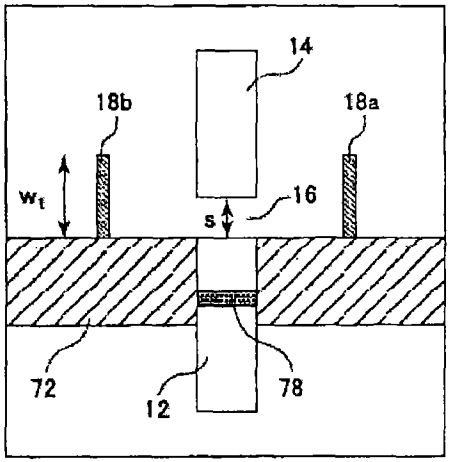

FIGS. 14A to 14C are views of the heat insulating transmission line of this embodiment viewed from three directions, illustrating a detail of the input portion specified by the dashed line circle in FIG. 13. FIGS. 14A, 14B and 14C are a sectional view cut in a vertical direction, a front view and a sectional view cut in a horizontal direction, respectively.

As shown in FIGS. 14A to 14C, the first waveguide 12 (FIGS. 14A and 14C) to input a signal from the outside of the housing 72 is connected to the housing 72 from the outside of the housing 72, i.e., the air side. Here, the heat insulating transmission line of this embodiment is provided with the airtight component to maintain the housing 72 as a vacuum. Specifically, in order to hold the airtightness of vacuum insulating chamber 70 (FIG. 13), the first waveguide 12 has the airtight component 78 (FIGS. 14A and 14C), such as glass and dielectrics, adhered by pressure bonding. As a result, the vacuum insulating chamber 70 is maintained as a vacuum. Furthermore, a seam between the first waveguide 12 and the housing 72 is welded, thereby forming an airtight structure.

The second waveguide 14 to output a signal to the side of the superconducting filter 76 is arranged across the air gap 16 to be lead to the first waveguide 12 inside the vacuum insulating chamber 70, i.e., inside the housing 72. The second waveguide 14 is fixed on the side of the superconducting filter 76, for example.

The planar reflector 18 including the two planar reflectors 18*a* and 18*b* (FIGS. 14B, 14C) facing each other across the air gap 16 (FIG. 14C) is mounted to the housing 72. The planar reflectors 18*a* and 18*b* are larger than the air gap 16 in size. When a mean frequency of a signal transmitting through the heat insulating transmission line is expressed as λ, the two planar reflectors 18*a* and 18*b* are placed so that a distance between the virtual surface of the radiation source and the planar reflectors 18*a*, 18*b* is not less than $N\times\lambda/2-0.05\lambda$ and not more than $N\times\lambda/2+0.2\lambda$ (N is a positive integer).

Generally, the superconducting filter is mounted to a refrigerator to be stored into the vacuum insulating chamber, and is cooled down to tens of K or less by insulating with maintaining the inside of the chamber as a vacuum. Conventionally, the vacuum insulating chamber has been connected to an external circuit using a coaxial line with a vacuum connector of coaxial type in order to connect the external circuit and the superconducting filter. The coaxial cable reduces heat transfer employing a low thermal conductivity component. The connector has a connecting structure to maintain a vacuum and electric conductivity. That is, the inner conductor of the connector adheres to the outer conductor therein with a brazing filler metal.

However, the inner conductor of Cu and the outer conductor of SUS (stainless steel) are coupled to the inside of the vacuum insulating chamber allows heat transfer from outside as much as 300K through the coaxial line. Therefore, an increase in the refrigerator load, temperature variations of the cooling portion of the refrigerator, and a reduction in the lifespan of the refrigerator are problems as a result of the heat transfer.

Then, the vacuum insulating chamber 70 of this embodiment effectively insulates using the heat insulating transmission line of the first to fifth embodiments for the portion to connect the outside and inside thereof. And this structure allows it to reduce the insertion loss. Thereby, this structure also allows it to efficiently control the characteristic degradation of the radio frequency equipment which is required to be cooled, and mounted inside the chamber 70.

Figure 15B:
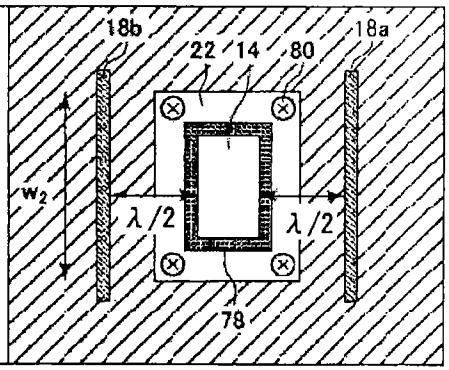
FIGS. 15A to 15C are views of the heat insulating transmission line of a modified example of the sixth embodiment viewed from three directions in FIG. 13.
Figure 15A:
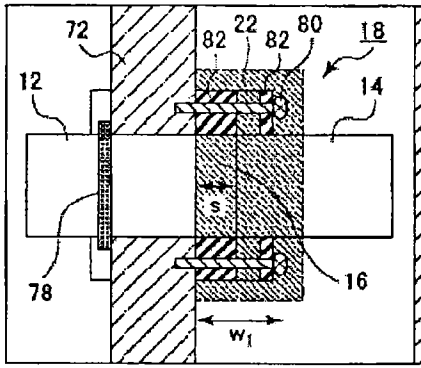
Figure 15C:
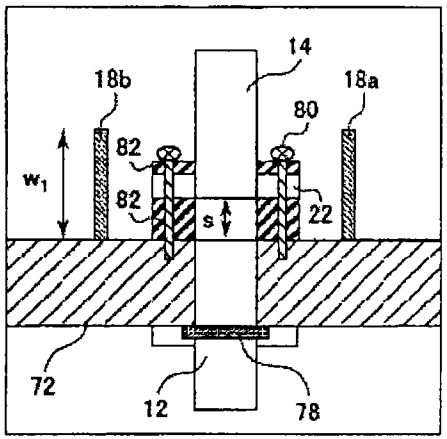

FIGS. 15A to 15C are views of the heat insulating transmission line of a modified example of this embodiment viewed from three directions, illustrating a detail of the input portion specified by the dashed line circle in FIG. 13. FIGS. 15A, 15B and 15C are a sectional view cut in a vertical direction, a front view and a sectional view cut in a horizontal direction, respectively.

As shown in FIGS. 15A and 15C, the first waveguide 12 to input a signal from the outside of the housing 72 is connected to the housing 72 from the outside of the housing 72. Here, the heat insulating transmission line of this embodiment is provided with the airtight component 78 to maintain the housing 72 as a vacuum (FIG. 15B). Specifically, in order to hold the airtightness of the vacuum insulating chamber 70 (FIG. 13), the first waveguide 12 has the airtight components 78, such as glass and dielectrics, attached by pressure bonding. As a result, the vacuum insulating chamber 70 is maintained as a vacuum.

The second waveguide 14 to output a signal to the side of the superconducting filter 76 (FIG. 13) is arranged across the air gap 16 (FIG. 15A) to be lead to the first waveguide 12 inside the vacuum insulating chamber 70, i.e., inside the housing 72. Here, the second waveguide 14 is mounted to the housing 72 of the vacuum insulating chamber 70 with maintaining the heat insulation thereof. Then the second waveguide 14 is fixed to the flange 22 with heat insulating screws 80 fixed through insulating components 82 (FIGS. 15A and 15C) into the flange 22.

Materials with sufficiently low heat conductivity are employed for the heat insulating screws 80 and the insulating components 82 shown in FIGS. 15A, 15B and 15C. The heat conductivity of the materials is preferably lower than that of a SUS stainless-steel. The materials include glass, TEFLON (registered trademark), i.e., polytetrafluoroethylene, and a ceramic component.

Contact areas among the insulating components 82, the heat insulating screws 80, and the second waveguide 14 are preferably made to be as small as possible. For example, the insulating components 82 are made to be a round shape in order to reduce the contact areas, thereby resulting in a higher insulating effect.

The configuration of the reflector 18 (FIG. 15A) is the same as that in the embodiments mentioned above.

The modified example has an advantage that the mounting and fixing of the heat insulating transmission line to the vacuum insulating chamber is simplified, in comparison with the embodiments mentioned above.

Seventh Embodiment

A wireless communication system of a seventh embodiment is provided with a signal processing circuit, a power amplifier, a heat insulating transmission line, a filter, and an antenna. The signal processing circuit performs transmission processing of send data to acquire a transmission signal. The amplifier amplifies the transmission signal. The heat insulating transmission line transmits the amplified transmission signal. The filter filters the transmission signal. The antenna radiates the filtered transmission signal as an electromagnetic wave into the air. Then, one of the heat insulating transmission lines of the first to fifth embodiments is employed for the seventh embodiment.

Figure 16:
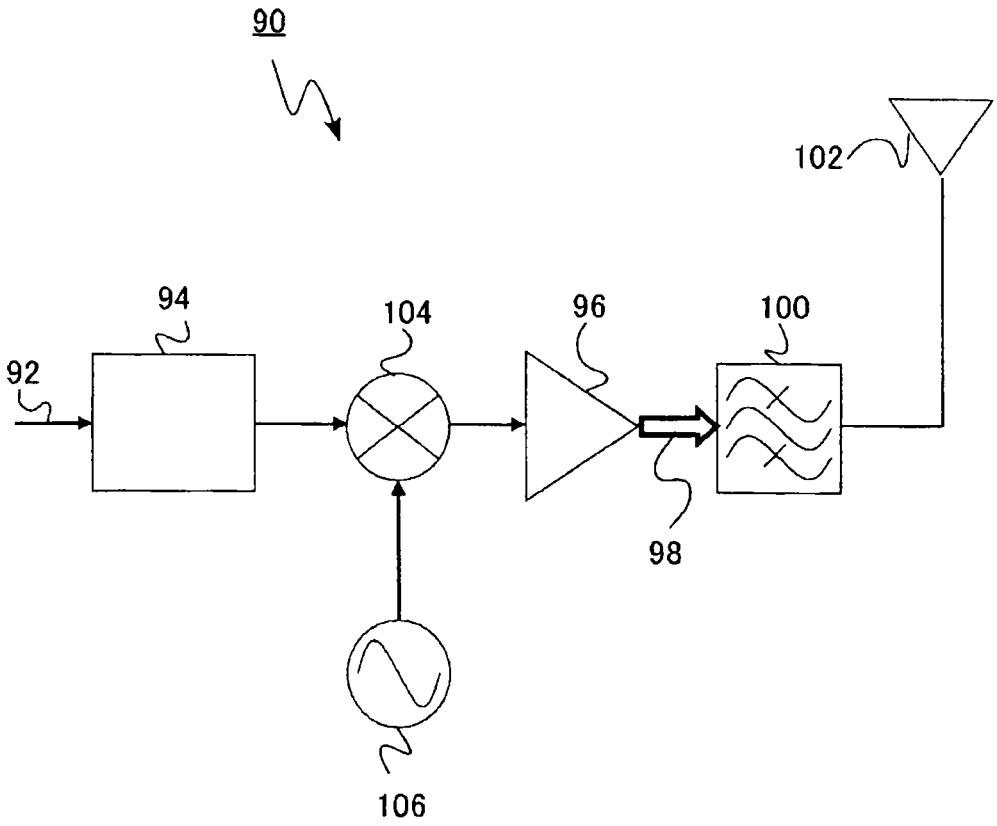
FIG. 16 is a schematic block diagram of a transmission section of a wireless communication system of a seventh embodiment.

FIG. 16 is a schematic block diagram of a transmission section of the wireless communication system of this embodiment. The wireless communication system 90 is provided with the heat insulating transmission line of the above-mentioned embodiments. Therefore, a detailed statement about the heat insulating transmission line is omitted below.

As shown in FIG. 16, the wireless communication system 90 is provided with a signal processing circuit 94, a power amplifier 96, a heat insulating transmission line 98, a filter 100, and an antenna 102. The signal processing circuit 94 performs transmitting processing of send data to acquire a transmission signal. The amplifier 96 amplifies the transmission signal. The heat insulating transmission line 98 transmits the amplified transmission signal. The filter 100 filters the transmission signal. The antenna 102 radiates the filtered transmission signal as an electromagnetic wave into the air. The wireless communication system 90 is provided with a frequency converter (a mixer) 104 and a local frequency generator 106.

The send data 92 is inputted into the signal-processing circuit 94, and is processed with digital-analog conversion, encoding, modulation, etc. to generate a transmission signal having a baseband or intermediate frequency. The transmission from the signal-processing circuit 94 is inputted into the frequency converter 104, and is multiplied by the local signal from the local signal generator 106 to be converted to a radio frequency (RF) signal, i.e., to be up-converted.

The RF signal outputted from the mixer 104 is amplified by the power amplifier 96, and is then inputted into a band-limiting filter (filter) 100. After an unnecessary frequency component is removed from the RF signal by the filter 100, the RF signal is supplied to the antenna 102.

Since a transmitter handles a large amount of power, the power amplifier 96 having better linearity tends to generate a larger amount of heat, thereby causing a problem. The heat generation of the amplifier 96 influences other circuits. For example, the power amplifier 96 generates heat to elevate the temperature of the circuit, e.g., the filter 100, the resonant frequency of the resonator configuring the filter 100 changes, thereby causing a problem.

According to the wireless communication system 90 of this embodiment, inserting one heat insulating transmission line 98 of the heat insulating transmission lines of the first to fifth embodiments between the power amplifier 96 and the filter 100 allows it to reduce the influence of the heat generation, thereby suppressing the insertion loss as a result of the high insulating effect of the heat insulating transmission line. Therefore, it is possible to provide a wireless communication system capable of performing a stable transmission.

The embodiments of the invention have been explained with reference to the examples. However, the present invention is not limited to these examples. For example, when those skilled in the art appropriately select to combine two or more of the configurations of the heat insulating transmission line, the vacuum insulating chamber, and the wireless communication system from a known range, and the same effect as described above can be obtained, they are also incorporated in the present invention.

The scope of the present invention is defined by the claims and the scope of the equivalent.

What is claimed is:

1. A vacuum insulating chamber, the chamber comprising:

a housing whose inside is maintained to be in a vacuum;

an airtight component to maintain the housing in the vacuum, a heat insulating transmission line capable of transmitting and receiving signals between equipment and a circuit outside the housing, the equipment being housed inside the housing, the heat insulating transmission line including:

a first waveguide with a first aperture end, the first waveguide mounted outside the housing;

a second waveguide with a second aperture end, the second waveguide mounted inside the housing and arranged coaxially with the first waveguide, the second aperture end facing the first aperture end;

an air gap between the first aperture end and the second aperture end; and a reflector provided outside the air gap, the reflector including two planar reflectors, the two planar reflectors facing each other across the air gap and spaced apart and thereby isolated from the first and second waveguides, the reflector suppressing power radiation from the air gap and being longer than a length of the air gap in a longitudinal direction of the first waveguide, wherein the two planar reflectors are substantially parallel to respective virtual planes including respective long sides of the first and second ends, the virtual planes each intersecting an inner wall of the first aperture end and an inner wall of the second aperture end; and a distance between each virtual plane and the respective reflector is not less than $N\times\lambda/2-0.05\lambda$ and not more than $N\times\lambda/2+0.2\lambda$ (N is a positive integer), provided that $\lambda$ is a mean frequency of a signal transmitting through the heat insulating transmission line.

2. The chamber according to claim 1, wherein the reflector is a conductor.

3. The chamber according to claim 1, wherein:

the second waveguide is connected to the housing through an insulating component; and heat conductivity of the insulating component is lower than that of a stainless-steel SUS.

* * * * *